US005343174A

United States Patent [19]

Turner et al.

[11] Patent Number: 5,343,174

[45] Date of Patent: Aug. 30, 1994

[54] ELECTRICAL CIRCUIT INTERRUPTING DEVICE WITH MEANS TO BREAK WELDED CONTACTS

[75] Inventors: David C. Turner, North Fayette; William G. Eberts, Moon, both of Pa.

[73] Assignee: Eaton Corporation, Cleveland, Ohio

[21] Appl. No.: 72,376

[22] Filed: Jun. 7, 1993

[51] Int. Cl.[5] ..... H01H 9/00

[52] U.S. Cl. ..... 335/172; 335/16

[58] Field of Search ..... 335/167–176, 335/16, 147, 195; 200/147 R

[56] References Cited

U.S. PATENT DOCUMENTS

| | | | |
|---|---|---|---|
| 4,638,277 | 1/1987 | Thomas et al. | 335/90 |
| 4,691,182 | 9/1987 | Mrenna et al. | 335/176 |
| 4,698,606 | 10/1987 | Mrenna et al. | 335/45 |
| 4,894,747 | 1/1990 | Livesey et al. | 361/376 |
| 5,142,112 | 8/1992 | Parks et al. | 200/401 |

*Primary Examiner*—Lincoln Donovan
*Attorney, Agent, or Firm*—M. J. Moran

[57] ABSTRACT

The movable contact arm of a circuit breaker is mounted on a pivot pin by a slot which extends generally transverse to the longitudinal arm of the contact arm, so that when the contacts are welded, initial motion of the circuit breaker operating mechanism to open the contacts is translated into pivoting of the contact arm about, and thereby breaking the weld. In a circuit breaker in which the contact arm is coupled to the operating mechanism through a cam mechanism which allows the contact arm to blow open in response to very high overcurrents, the slot extends generally longitudinally so that the cam mechanism translates initial movement of the operating mechanism into longitudinal movement of the contact arm to apply a shear force tending to break the weld.

2 Claims, 3 Drawing Sheets

FIG.5
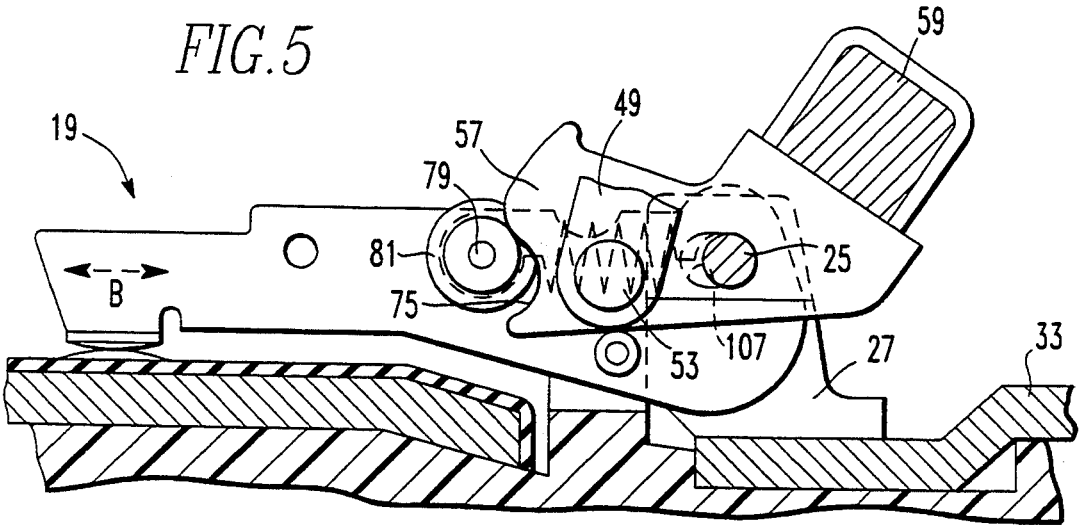
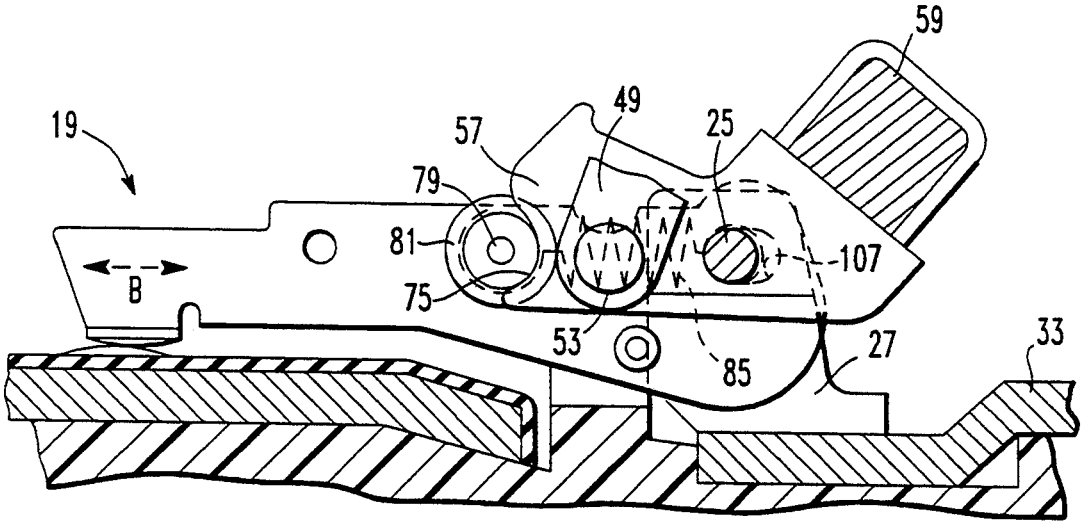
FIG.6

ELECTRICAL CIRCUIT INTERRUPTING DEVICE WITH MEANS TO BREAK WELDED CONTACTS

BACKGROUND OF THE INVENTION

1. Field of the Invention

This invention relates to an electrical circuit interrupting device such as a molded case circuit breaker having a mechanism for applying a force to break open contacts which have become welded closed.

2. Background Information

Certain types of electrical circuit interrupting devices such as molded case circuit breakers, have for each phase a set of separable contacts including in a fixed contact secured to the molded casing and a moveable contact mounted near one end of an elongated contact arm which is pivotally mounted at the opposite end. An operating mechanism actuated manually by a handle, or automatically by a trip mechanism responsive to various over-current conditions, pivots the contact arm to open and close the contacts. Some of these molded case circuit breakers, for instance those disclosed in U.S. Pat. Nos. 4,894,747 and 5,142,112, have a coupling between the operating mechanism and the contact arm which permits the contact arm to blow open through the operation of repulsion forces in response to very large overcurrents before the operating mechanism can respond through the trip device. It has been found, however, that high in-rush currents such as those caused by the starting of a motor in a circuit protected by the molded case circuit breaker, can cause the contacts to chatter resulting in welding of the contacts in a closed position which is obviously an undesirable and unsafe condition. Light welds can be broken by the operating mechanism either automatically through operation of the trip device or by application of a manual force in the open direction on the handle. However, the operating mechanism is typically connected to the contact arm close to the pivot point of the arm and, therefore, does not have sufficient mechanical advantage to break stronger welds with the force that can be generated with the operating mechanism.

There is a need, therefore, for an improved circuit interrupting device in which sufficient force can be generated through the operating mechanism to break any welds that may develop between the contacts.

There is a further need for providing such a feature on present circuit breaker designs which does not require extensive modification of the circuit breaker and is not costly.

SUMMARY OF THE INVENTION

These and other needs are satisfied by the invention which is directed to an electrical circuit interrupting device in which the moveable contact arm, having the movable contact mounted adjacent one end, is mounted at the second end by mounting means which allows translation as well as rotation of the second end by the operating mechanism relative to a pivot member to break any welds between the moveable contact and the fixed contact. In one embodiment, in which the mounting means takes the form of a transverse slot in the contact arm through which the pivot member extends, the operating mechanism lifts the second end of the contact arm to pivot it about, and thereby break, the weld.

In a second embodiment of the invention adapted for use with a contact arm structure which includes a blow-open camming device, the slot extends generally longitudinally in the contact arm. When the operating mechanism applies a force to the contact arm, with the contacts welded closed, the camming device translates the motion of the operating mechanism initially into longitudinal movement of the contact arm. This applies a shear force which breaks the weld. In both cases, translation of the pivoted end of the contact arm results in the application of a force to the weld which is more effective in breaking the weld than the force applied to the weld by normal rotation of the contact arm about its pivot point.

BRIEF DESCRIPTION OF THE DRAWINGS

A full understanding of the invention can be gained from the following description of the preferred embodiment when read in conjunction with the accompanying drawings in which:

FIG. 5 is a view similar to FIG. 1 illustrating a second embodiment of the invention.

FIG. 6 is a side elevation view of the contact arm of the circuit breaker of FIG. 5 illustrating operation of the invention.

DESCRIPTION OF THE PREFERRED EMBODIMENTS

Figure 1:
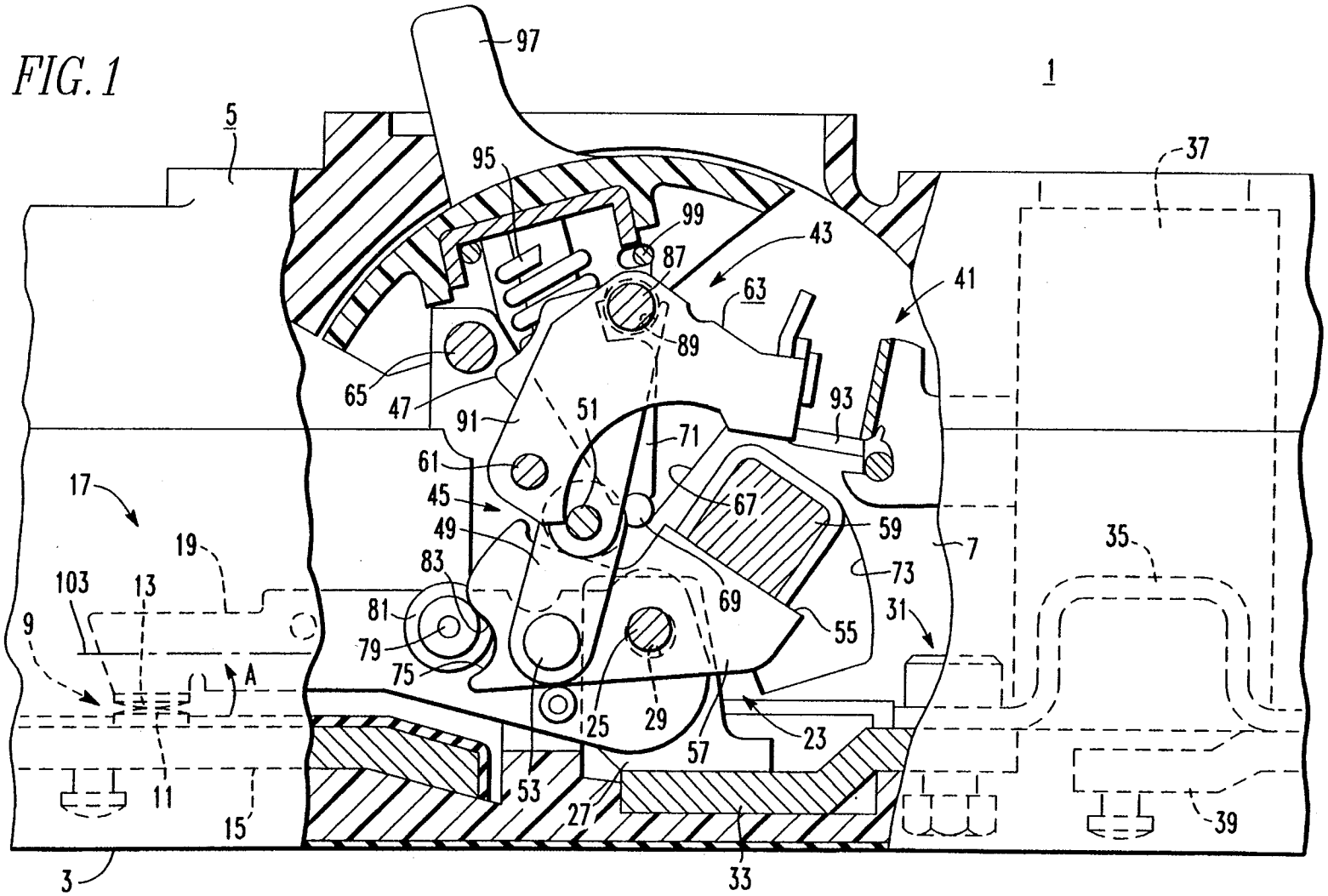
FIG. 1 is a side elevation view with part broken away of a circuit breaker incorporating one embodiment of the invention and shown in a closed position.
Figure 3:
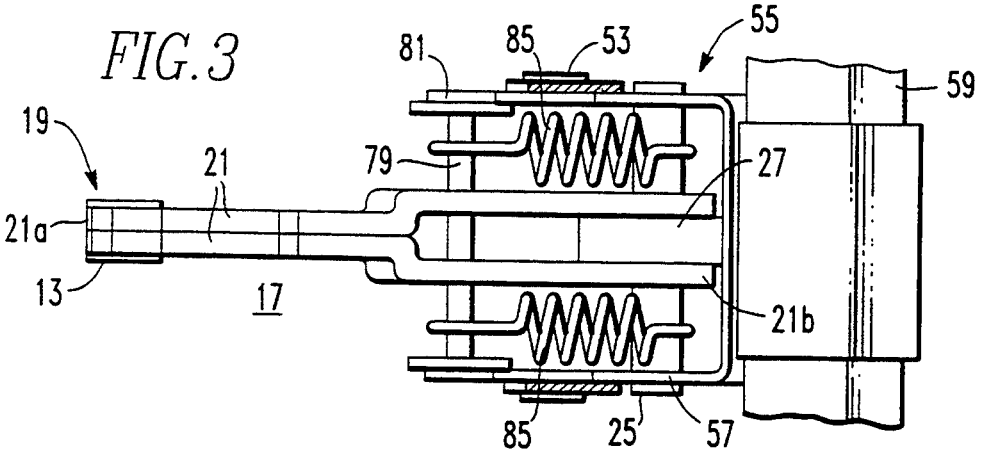
FIG. 3 is a plan view of the contact arm structure shown in FIG. 2.

The circuit breaker 1 shown in FIG. 1 is of the molded case type such as is shown in U.S. Pat. No. 5,142,121 which is hereby incorporated by reference. The circuit breaker 1 comprises a molded base 3 and a molded cover 5. A pair of side plates 7 (only one shown) form a frame for supporting various components of the circuit breaker.

The circuit breaker 1 includes for each phase a pair of separable main contacts 9. The set of contacts 9 includes a fixed contact 11 and a moveable contact 13. The fixed contact 11 is mounted on a line-side conductor 12 which extends to a line-side connector (not shown) for connection to the electrical supply system.

Figure 2:
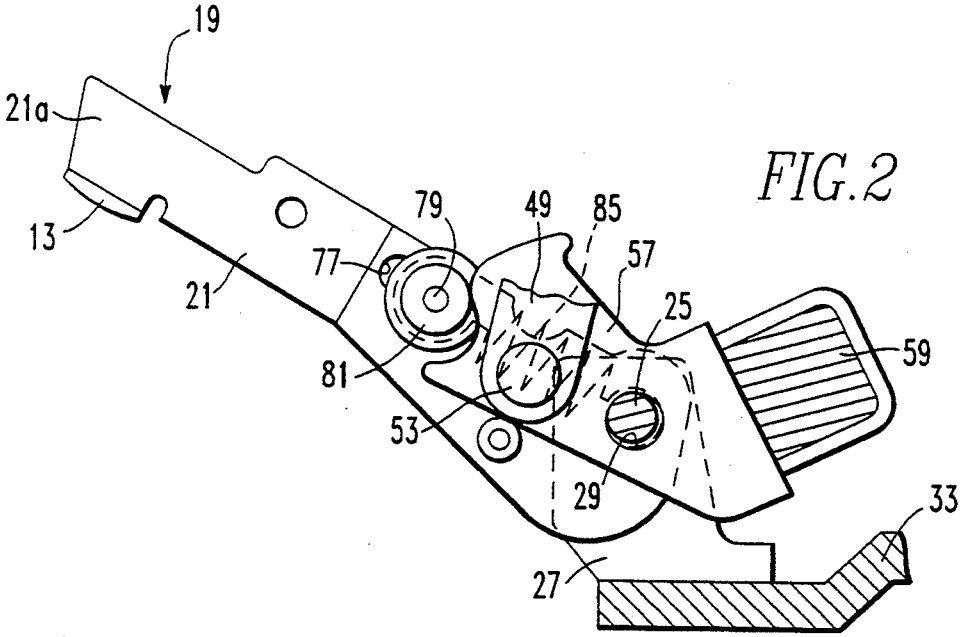
FIG. 2 is a side elevation view of the contact arm of the circuit breaker of FIG. 1 shown in the open position.

The moveable contact 13 is carried by a moveable contact structure 17. The moveable contact structure 17 includes an elongated moveable contact arm 19, which as seen in FIG. 2 is formed of two elongated members 21 riveted together at one end 21*a* and spread apart at second ends 21*b*. The moveable contact 13 is secured adjacent the first end of the elongated moveable contact arm 19.

The contact arm 19 is pivotally mounted adjacent the second end 21*b* by a mount 23 which includes a pivot pin 25 supported by a pivot bracket 27. As seen in FIG. 2 the second ends 21*b* of the arm members 21 straddle the pivot bracket 27. The pivot pin 25 extends through the pivot bracket 27 and into mounting holes 29 in the arm members 21 of the contact arm 19.

The pivot bracket 27 forms part of a load conductor assembly 31 which includes a load conductor base member 33 on which the pivot bracket 27 is mounted. The load conductor base member 33 is secured in the molded base 3 and connected at its opposite end to a load conductor 35. The load conductor 35 is also connected to a load terminal 39 which in turn is connected to the electrical circuit (not shown) to be protected. The load conductor 35 also forms a portion of a trip unit 37.

The trip unit 37 does not form a portion of the present invention and may be, for example, an electronic trip unit or a thermal magnetic trip unit as described in detail in U.S. Pat. No. 4,691,182 and 4,698,606, assigned to the assignee of the present invention and hereby incorporated by reference. The trip unit 37 includes a latch mechanism 41 that is interlocked with an operating mechanism 43. The trip unit 37 responds to overcurrent conditions in the load conductor 35 by operating the latch mechanism 41 to unlatch the operating mechanism 43 which opens the contacts 9.

The operating mechanism 43 is provided for opening and closing the separable contacts 9. This operating mechanism 43 includes a toggle assembly 45 comprising a pair of upper toggle links 47 and a pair of lower toggle links 49 pivotally connected together by a toggle knee pin 51. The lower ends of the lower toggle links 49 are pivotally connected by a pin 53 to a U-shaped bracket 55 having arms 57. The U-shaped bracket 55 is rigidly connected to a cross-bar 59 which carries a U-shaped bracket such as 55 for each pole of the circuit breaker 1. The arms 57 of the U-shaped bracket 55 straddle the contact arm 19 and are pivotally connected by the pivot pin 25. Thus the bracket 55 supports the cross-bar 59 for rotation about the pivot pin 25.

The pivot pin 25 is supported by the pivot bracket 27 and also at its ends by the side plates 7. The side plates 7 also support a pin 61 on which a cradle assembly 63, which forms part of the operating mechanism 43, is rotatably mounted. The side plates 7 also support a stop pin 65 which limits rotation of the cradle assembly 63 during tripping of the circuit breaker 1. A V-shaped notch 67 in each side plate 7 captures a pivot pin 69 for a handle yoke 71. Also, an arcuate slot 73 in the side plate 7 allows the cross bar 59 to pivot about the pivot pin 25.

Figure 4:
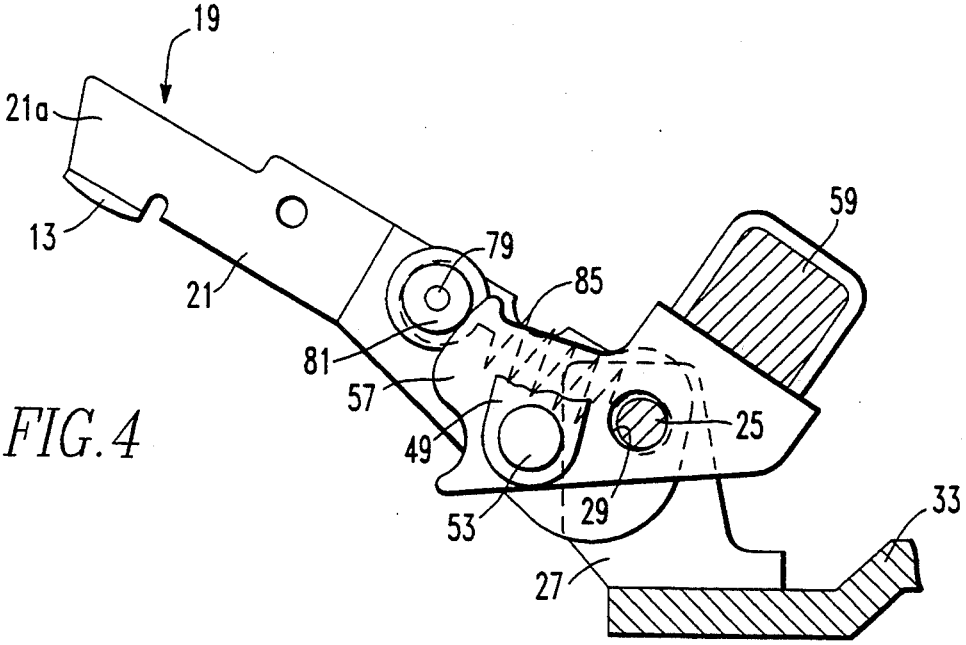
FIG. 4 is a side elevation view of the contact arm of the circuit breaker of FIG. 1 shown in a blown open position.

The arms 57 of the U-shaped brackets 55 are provided with camming surfaces 75. These camming surfaces 75 allow for mechanical coupling of the contact arms 19 to the operating mechanism 43. More specifically, each of the contact arms 19 is provided with a slot 77 for receiving a cam roller pin 79. The cam roller pin 79 extends outwardly from the sides of the contact arm 19. Cam rollers 81 mounted on the ends of the cam roller pin 79 engage the camming surfaces 75 to mechanically couple the contact arms 19 to the operating mechanism 43. In all conditions except a blown open condition, the cam rolls 81 are captured in a pocket 83 formed in the camming surfaces 75. In a blown open condition, the cam rollers 81 are displaced out of the pockets 83 by the magnetic repulsion forces to uncouple the operating mechanism 43 from the contact arm 19 as shown in FIG. 4. This allows the contact arms 19 to open independently of the operating mechanism 43 in response to very large fault currents, to avoid a situation where the current exceeds the capacity of the circuit breaker 1 to interrupt by the time the operating mechanism responds.

A pair of biasing springs 85 connected between the cam roller pins 81 and the pivot pin 25, provide contact pressure which must be overcome by the magnetic repulsion forces in order to allow the contact arm 19 to be blown open. More specifically, in the on position, as shown in FIG. 1, the cam rollers 81 are not fully seated in the pockets 83, but rather, are located slightly high in the pockets 83, and therefore, the contact arm 19 is urged in a counterclockwise direction as shown in FIG. 1 by the biasing springs 85. This produces a contact pressure between the separable contacts 9.

The upper toggle links 47 are pivotally connected to the cradle assembly 63 through a pivot pin 87. More specifically, the upper toggle links 47 each have a U-shaped notch 89 at the upper end which receives the pivot pin 87 carried by the cradle assembly 63. The cradle assembly 63 has a pair of cradle arms 91 through which the cradle assembly 63 is pivotally supported by the cradle pin 61.

The cradle assembly 63 may be, for example, of the type described in detail in U.S. Pat. No. 4,894,747 which is hereby incorporated by reference. The cradle assembly 63 includes a latch surface 93 which is engaged by the latch mechanism 41 of the trip unit 37. When the latch surface 93 is engaged by the latch mechanism 41, operating springs 95, connected between the toggle knee pin 51 and the handle yoke 71, bias the operating mechanism 43 to erect the toggle assembly 45 to close the separable contacts 9 by rotating the contact arm 19 about the pivot pin 25. In response to an overcurrent condition, the latch mechanism 41 on the trip unit 37 releases the latch surface 93 on the cradle assembly 63. The operating springs 95 then cause the cradle assembly 63 to rotate in a counterclockwise direction in FIG. 1 about the cradle pin 61 which causes the toggle assembly 45 to collapse. This causes the arms 57 on the U-shaped brackets 55, and therefore, the cross-bar 59, to rotate in a clockwise direction, thereby rotating the contact arms 19 and opening the separable contacts 9.

The circuit breaker 1 can also be manually turned off by rotating an insulated operating handle 97 mounted to the handle yoke 71 in a clockwise direction. When the line of action of the springs 95 moves to the right of the pin 87 as viewed in FIG. 1, the toggle assembly 45 collapses which rotates the contact arm 19 clockwise and again opens the separable contacts 9.

Once the latch surface 93 on the cradle assembly 63 has been disengaged form the latch mechanism 41 on the trip unit 37 during a tripping operation, it is necessary to reset the operating mechanism 43. This is accomplished by rotating the operating handle 97 in the clockwise direction, as seen in FIG. 1, until the latch surface 93 on cradle assembly 63 engages the latch mechanism 41 on the trip unit 37. A pin 99 on the handle yoke 71 engages the cradle arms 91 to effect this rotation of the cradle assembly 63.

As mentioned above, under certain conditions it is possible for the separable contacts 9 to become welded closed. It can be seen from FIG. 1 that the pin 53 through which the operating mechanism applies the force to rotate the contact arm 19 to the open position is close to the pivot pin 25 about which the contact arm 19 rotates. As a result, the force supplied by the operating mechanism to welded contacts through this short lever arm is insufficient to break significant welds.

In accordance with the embodiment of the invention as illustrated in FIG. 1, the holes 29 in the arm members 21 of the contact arm 19 are elongated to form a slot which is generally transverse to the longitudinal axis 103 of the contact arm 19. Actually, the slot 29 can be an arc centered on the contact point of the separable contacts. With slot 29 in the arm members 21, the initial motion of the lower toggle links 49 in response to tripping of the trip mechanism 37 or movement of the operating handle 97 toward the open position lifts the second ends 21*b* of the arm members 21 of the contact arm 19. This pivots the contact arm 19 about the weld 105 which breaks the weld open. When the bottom of the slot 29 is engaged by the pivot 25 further movement of the operating mechanism 43 causes the contact arm 19 to rotate about the pivot pin 25 in a conventional manner.

A second embodiment of the invention is shown in FIGS. 5 and 6. In this embodiment, the holes 29 in the arm members 21 of the contact arm 19 are elongated in the direction of the longitudinal axis 103 of the contact arm 19 to form generally longitudinally extending slots 107. If the contacts 9 are welded closed, initial movement of the operating mechanism 43 is translated by the camming surfaces 75 into longitudinal movement of the contact arm 19 which applies a shear force to break the weld 105.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the appended claims and any and all equivalents thereof.

What is claimed is:

1. An electrical circuit interrupting device comprising:

a pair of separable contacts comprising a fixed contact and a moveable contact;

a moveable contact arm structure comprising an elongated, moveable contact arm having said moveable contact mounted adjacent a first end thereof, a pivot member, and mounting means adjacent a second end of said moveable contact arm and mounting said moveable contact arm for rotation about said pivot member to open and close said separable contacts; and an operating mechanism connected to said moveable contact arm for rotating said moveable contact arm about said pivot member to open and close said separable contacts, said mounting means characterized by means permitting generally longitudinal translation as well as said rotation of said second end of said moveable contact arm relative to said pivot member by said operating mechanism to apply a shear force between the contacts to break any weld between said separable contacts.

2. The electrical circuit interrupting device of claim 1 wherein:

said contact arm structure includes a blow open camming means through which said operating mechanism is connected to said moveable contact arm and which permits said moveable contact arm to rotate about said pivot member and open said separable contacts in response to magnetic repulsion forces generated by a large current through said separable contacts before operation of said operating mechanism, and wherein said mounting means comprises a generally longitudinally extending slot is said moveable contact arm through which said pivot member extends, said blow open camming means translating initial movement by said operating mechanism to open said separable contacts into said generally longitudinal translation of said elongated moveable contact arm to apply a shear force tending to break any weld between said separable contacts.

* * * * *